United States Patent [19]

Palazzola

[11] Patent Number: 4,976,070

[45] Date of Patent: Dec. 11, 1990

[54] ADJUSTABLE CAM

[76] Inventor: Anthony Palazzola, 6371 Oakhill Rd., Ortonville, Mich. 48462

[21] Appl. No.: 406,156

[22] Filed: Sep. 12, 1989

[51] Int. Cl.[5] ..... B24B 7/00

[52] U.S. Cl. ..... 51/101 R; 51/165.79; 51/100 R; 74/568 R

[58] Field of Search ..... 51/101 R, 165.79, 100 R; 74/568

[56] References Cited

U.S. PATENT DOCUMENTS 2,180,844 11/1939 Dahl ..... 74/568

4,587,767 5/1986 Giebmanns ..... 51/101 R

*Primary Examiner*—Frederick R. Schmidt

*Assistant Examiner*—M. Rachuba

*Attorney, Agent, or Firm*—Dykema Gossett

[57] ABSTRACT

An adjustable cam is disclosed for use in grinding apparatus of the type where a cam pivots a part holder into and away from a grinding wheel. The adjustable cam consists of a central portion having two adjustable portions fixed at its ends such that the adjustable portions can be moved towards and away from a center position to result in a cam having a desired length. By selecting an adjustable portion having a desired width and radius and adjusting the distance between the two adjustable portions, a cam can be achieved that roughly corresponds to the final desired dimensions of the cam quickly and inexpensively. Some finish grinding may then be necessary in order to ensure that the final cam has the exact desired dimensions.

4 Claims, 3 Drawing Sheets

PRIOR ART

ADJUSTABLE CAM

BACKGROUND OF THE INVENTION

This invention relates to a cam for use with rotating grinding machines that may be adjusted to achieve a desired dimension.

A dog bone shaped part 20 that is typically formed by grinding equipment is illustrated in Prior Art FIG. 1 and consists of portions 22 having an inner end 24 and a curved outer end 26. A central portion 28 connects the portions 22.

The distance between the outer ends 26 of portions 22 is defined as a dimension Y and the width of portions 22 is defined as a dimension X, a dimension R is defined as the radius of the portions 22. Each of these three dimensions must be accurately machined to within close tolerances.

A cam 30 known in the prior art is shown in Prior Art FIG. 2 and consists of portions 32 that correspond to portions 22 of the part 20. Shaft 34 mounts cam 30 within a grinding apparatus and portions 32 of cam 30 form the desired dimensions and shape of portions 22 of dog bone part 20.

A typical prior art grinding apparatus is shown in Prior Art FIG. 3 and consists of cam 30 mounted within guide member 36 upon which a part 38 is connected at 40. Part 38, connection 40 and cam 30 are all driven to rotate within guide 36. A grinding wheel 42 is positioned such that part 38 is periodically brought into contact with it as cam 30 rotates along cam surface 44.

As shown in Prior Art FIG. 4, cam 30 rotates along cam surface 44 and guide member 36 is pivoted towards and away from grinding wheel 42 on pin 46 which is fixed in base 48. As cam 30 rotates on cam surface 44, guide 36 moves part 38, into and away from, grinding wheel 42 to form a surface corresponding to cam 30 on part 38. By ensuring the dimensions X, Y and R on cam 30 are accurate, part 38, formed by grinding wheel 42, will be accurately dimensioned.

In constructing prior art cam 30, problems were encountered since it is time consuming and expensive to accurately machine all three dimensions on a cam. This is particularly true when only a small run of dog bone parts 20 is to be run. In many instances, it was not economically feasible to create a cam 30 for a small run of parts 20. Several repeated grinding operations were required to change a piece of metal into a cam having the desired X, Y and R dimensions for a particular part.

It is therefore an object of the present invention to describe an adjustable cam that can be adjusted to correspond to a variety of dimensions and thus may be quickly and inexpensively tailored to suit the desired dimension of a particular dog bone part 20.

SUMMARY OF THE INVENTION

In a preferred embodiment of the present invention an adjustable cam consists of an elongate central holder portion having a shaft for being mounting within a guide member of a grinding machine and a pair of spaced bolt holes. A pair of adjustable portions are slidably mounted upon bolts which pass through the bolt holes. The adjustable portions are selected to have approximately the desired radius and width of the desired dog bone part that is to be ground and have slots through which the bolts slide to adjust the length, or Y dimension of the cam. The slot is of a length greater than the diameter of the bolt hole, allowing a degree of adjustability.

The slot has a counter sunk bore such that the bolt will be firmly received and will tightly grip the adjustable portions. The elongate central holder portion also has a ledge member that acts as a stop to limit the movement of the adjustable portions.

An operator merely selects a elongate central holder portion for the adjustable cam and then selects two adjustable portions that approximately correspond to the desired width, X, dimension and radius, R dimension. These two adjustable portions are mounted on the elongate central holder portion by passing the bolt through the slot and into the bolt hole in the elongate central holder portion. The two adjustable portions are moved until that their outer end are separated by the desired length. The bolts are then tightened to secure the adjustable portions at this position resulting in a cam that has the desired length. The ledge member may be used as a center point to aid in measuring the distance to the outer end of the adjustable portion.

Some slight grinding may then be necessary to ensure the cam has the exact desired width, radius and length. However, any required grinding will be relatively minor when compared to that required in the prior art.

These and other features and objects of the present invention can be best understood from the following specification and appended drawings of which the following is a brief description thereof.

DETAILED DESCRIPTION OF A PREFERRED EMBODIMENT

Figure 3:
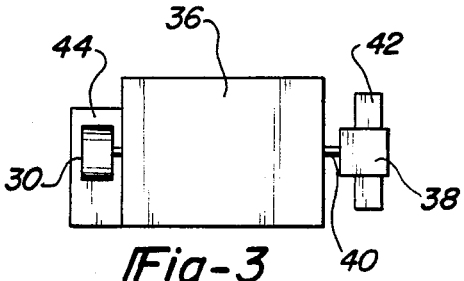
Fig-3 PRIOR ART
FIG. 3 is a view, largely schematic, of a prior art grinding apparatus.
Figure 4:
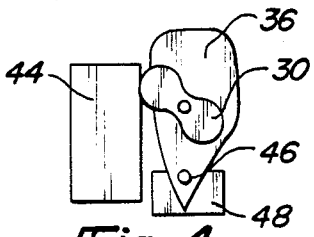
Fig-4 PRIOR ART
FIG. 4 is a view, largely schematic, along one end of the prior art grinding apparatus illustrated in FIG. 3.

It is to be understood that an adjustable cam as disclosed in FIG. 5–9 will replace cam 30 in the grinding apparatus illustrated in Prior Art FIGS. 3 and 4.

Figure 1:
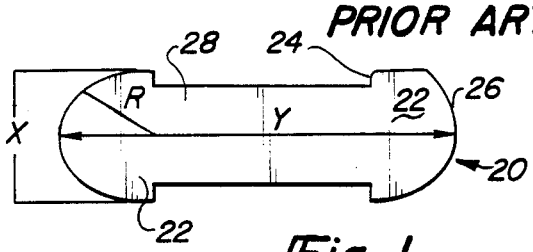
FIG. 1 is a side view of a dog bone part as known in the prior art.
Figure 5:
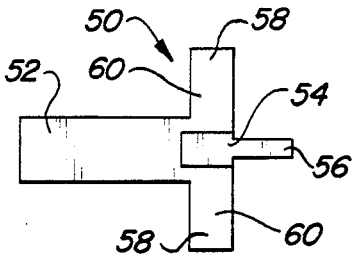
Fig-5 PRIOR ART
FIG. 5 is a cross-section view through a elongate central holder portion of an adjustable cam as disclosed by the present invention.
Figure 2:
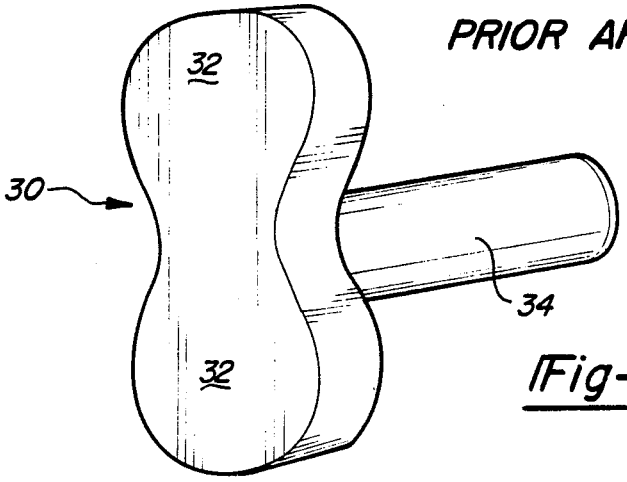
FIG. 2 is a side view of a prior art cam for forming a part such as shown in FIG. 1.
Figure 6:
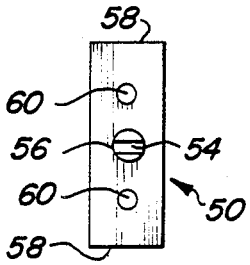
FIG. 6 is an end view of the elongate central holder portion illustrated in FIG. 5.

Elongate central holder portion 50 is illustrated in FIGS. 5 and 6, and consists of shaft portion 52 at a central position 54 for mounting within guide member 36 of a grinding apparatus. Elongate central holder portion 50 includes dowel, or ledge 56 which is fixed at the central position 54, and two ends 58; bolt holes 60 are spaced between central position 54 and ends 58 and extend through the extent of elongate central holder portion 50.

Figure 7:
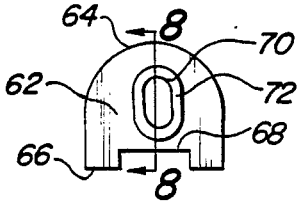
FIG. 7 is an end view of an adjustable portion as disclosed by the present invention.

As shown in FIG. 7, adjustable portions 62 each have outer end 64 and inner end 66 with notched portion 68. Slot 70 extends through the width of adjustable portions 62 and is of a length greater than the diameter of bolt holes 60. Thus, a bolt extending through bolt hole 60 can be received within slot 70 and the bolt can slide within slot 60 to allow adjustment of the position of adjustable portion 62 with respect to elongate central holder portion 50. Counter sunk bore 72 receives a bolt head and tightly secures adjustable portion 62 to elongate central holder portion 50.

Figure 8:
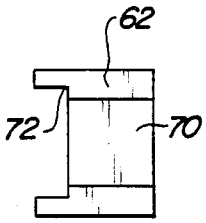
FIG. 8 is a cross-section through the adjustable portion illustrated in FIG. 7.

As shown In FIG. 8, counter sunk bore 72 is essentially a ridge formed at one end of adjustable portions 62. Slot 70 is shown extending through the width of adjustable portion 62 and receives a bolt associated with bolt hole 60.

Figure 9:
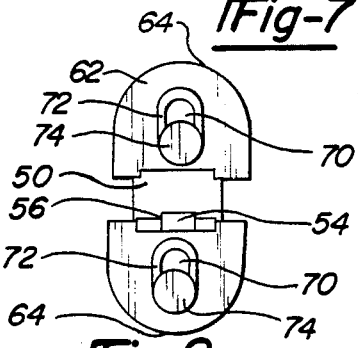
FIG. 9 is an end view showing the fully assembled adjustable cam.

As shown in FIG. 9, a pair of adjustable portions 62 are mounted on bolts 74 which extend through slots 70 and into bolt holes 60. Adjustable portions 62 are moved toward and away from central portion 54 upon bolts 74 to adjust the distance between their respective outer ends 64 to reach a desired length, or Y dimension. The top adjustable portions 62 is shown with bolt 74 received at an inner extent of slot 70. This corresponds to the greatest possible distance between outer end 64 and central position 54.

The lower adjustable portion 62 is shown with bolt 74 received at an outer extent of slot 70. This corresponds to the position of adjustable portions 62 closest to central portion 54. By adjusting the relative positions of the two adjustable portions, the distance between the two outer ends 64 can be adjusted to reach a desired length, or Y dimension.

Now, the method of assembly for an adjustable cam in accordance with the present invention will be disclosed with reference to FIG. 5–9. Adjustable portions 62 are selected having width, X and radius, R that roughly correspond to a desired dimension of a final dog bone part 20. Bolts 72 are inserted within slots 70 with the bolt head being received in counter sunk bores 72 and the threaded portion of the bolt received in bolt holes 60. The adjustable portions are then moved with bolts 74 sliding within slots 70 until the adjustable portion 62 have been moved to desired positions so that the distance between outer ends 64 of the two adjustable portions 62 corresponds to the desired length Y. Bolts 74 are then tightened resulting in a final adjusted cam. Alternatively, the distance between ledge 56 and outer end 64 can be measured to find the appropriate position for adjustable portion 62. Since the can is symmetrical, measurement between central position 54 and outer ends 64 can be used rather than directly measuring the distance between the two outer ends 64.

Some grinding may then be necessary to achieve the exact final desired width, radius and length dimensions. However, this required grinding will be relatively minor when compared with the prior art grinding in which the entire profile of the cam needed to be ground. The adjusted cam is then mounted in a grinding apparatus.

An adjustable cam as disclosed by this invention could have a shape other than dog bone. Any shape can be achieved by selecting correspondingly shaped adjustable portions.

A working embodiment of the present invention has been disclosed, however, a worker in the art would realize that certain modifications are within the scope of this invention. The following claims should be considered in order to determine the true scope and content of the present invention.

I claim:

1. A grinding machine comprising; a grinding wheel; a guide member pivotally guided into and away from said grinding wheel; a part holder rotatably driven within said guide member; and a cam rotatably driven within said part holder;

rotation of said cam pivoting said guide member into and away from said grinding wheel;

said cam having, an elongate central holder portion having two ends and a shaft at a central position intermediate said two ends, there being at least one securing means, and at least one adjustable portion, each adjustable portion having an outer end facing away from said central position and an inner end facing toward said central position, there being securing means upon said adjustable portion corresponding to said securing means said elongate central holder portion, said securing means allowing movement of said adjustable portions selectively towards and away from said central position to a desired position, said securing means securing said adjustable portion to said elongate central holder portion at said desired position, said desired position resulting in a cam having a desired length between said central portion and the outer end of said adjustable portion.

2. A grinding machine as recited in claim 1 and wherein there being two of said adjustable portions and corresponding securing means thus allowing each of said adjustable portions to be positioned in a desired position.

3. A grinding machine as recited in claim 2, and wherein said securing means consist of a bolt that is received within a slot in said adjustable portion and in a bolt hole in said elongate central holder portion.

4. A grinding machine as recited in claim 3, and further wherein said bolt is received in a counter sunk bore in said slot.

* * * * *